US005256257A

United States Patent [19]

Schiel

[11] Patent Number: 5,256,257

[45] Date of Patent: Oct. 26, 1993

[54] PRESS BELT SUPPORT FOR COMPACT PRESS SECTION OF PAPER MAKING MACHINE

[75] Inventor: Christian Schiel, Heidenheim, Fed. Rep. of Germany

[73] Assignee: J. M. Voith GmbH, Fed. Rep. of Germany

[21] Appl. No.: 826,364

[22] Filed: Jan. 27, 1992

[30] Foreign Application Priority Data

Jan. 26, 1991 [DE] Fed. Rep. of Germany ..... 4102356

[51] Int. Cl.[5] ..... D21F 3/04

[52] U.S. Cl. ..... 162/360.3; 162/358.3; 162/359.1

[58] Field of Search ..... 162/358, 359, 360.1, 162/305, 360.3, 358.3, 358.4, 359.1

[56] References Cited

U.S. PATENT DOCUMENTS

| | | | |
|---|---|---|---|
| 3,861,997 | 1/1975 | Ely | 162/360 |
| 4,359,827 | 11/1982 | Thomas | 162/300 |
| 4,483,745 | 11/1984 | Wicks et al. | 162/360.1 |
| 4,526,655 | 7/1985 | Karvinen et al. | 162/360.1 |
| 4,586,984 | 5/1986 | Laapotti | 162/359 |
| 4,880,502 | 11/1989 | Wedel | 162/358 |
| 4,976,821 | 11/1990 | Laapotti | 162/360.1 |
| 5,002,638 | 3/1991 | Guyla et al. | 162/359 |

FOREIGN PATENT DOCUMENTS 0334201 9/1989 European Pat. Off. .

OTHER PUBLICATIONS

Dimick "Innovative Press Felt Design Helps Mill Improve Runability" P&P May 1989.

*Primary Examiner*—Karen M. Hastings

*Attorney, Agent, or Firm*—Ostrolenk, Faber, Gerb & Soffen

[57] ABSTRACT

In the press section of a paper making machine, there is a central roll, a first press roll beneath and a second press roll above the central roll defining respective first and second press nips. The first press nip or both nips may be extended nip presses. A water impervious press belt travels through the first press nip around the central roll and through the second press nip, meeting the central roll before the first nip and leaving the central roll after the second nip. A felt belt conducts the web to be dewatered into the first nip along with the press belt. The felt belt separates from the web after the first nip. Following the second press nip, the press belt carries the web to a place of removal where a dryer wire picks up the web. The distance from the second press nip to the place of removal is at least equal to the circumference of and is preferably greater than the circumference of the central roll. The path of the press belt from the second nip to the removal place may be bent by a deflection roll.

28 Claims, 2 Drawing Sheets

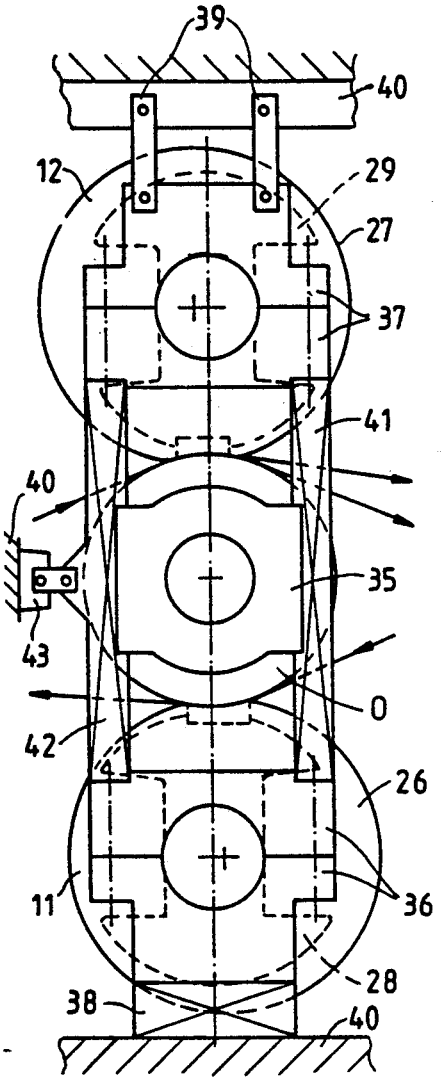
Fig.2
Fig.3
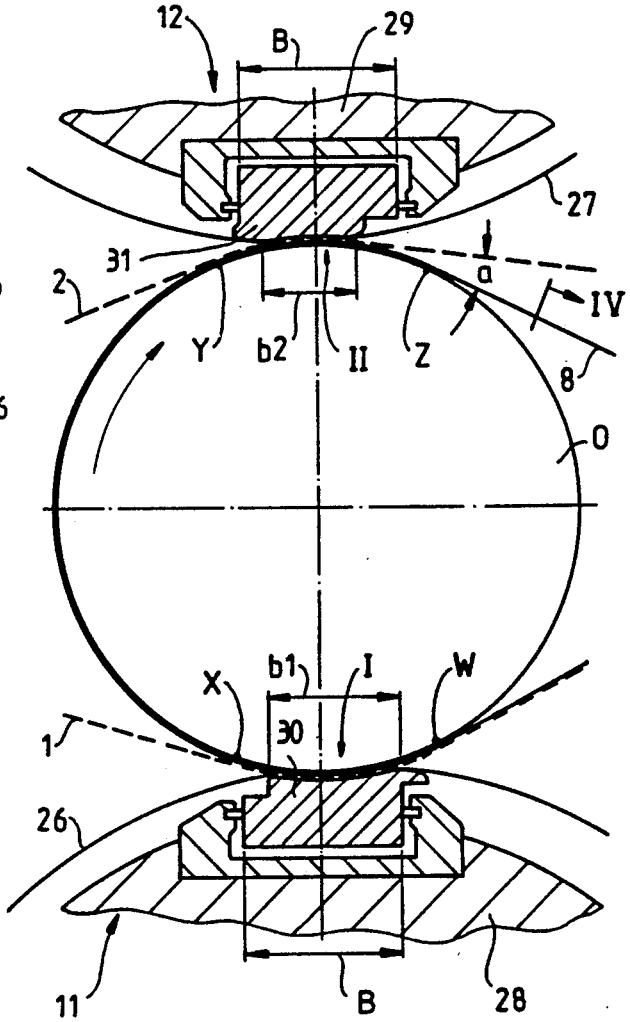
Fig.4
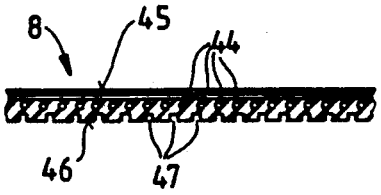

PRESS BELT SUPPORT FOR COMPACT PRESS SECTION OF PAPER MAKING MACHINE

BACKGROUND OF THE INVENTION

The present invention relates to a press section of a machine for the manufacture of a fiber web, and particularly a paper web. In particular, the invention relates to the press nips and to the press belt which moves through the two press nips which are formed in a press having a single central roll. Such a press section of a paper making machine is comprised of a central roll, a first press roll at one side and a second press roll generally at the opposite side of the central roll, wherein the press rolls respectively define first and second press nips. A substantially water impervious, endless press belt travels through the first press nip, wraps around the central roll, travels through the second press nip and leaves the central roll. An endless felt belt guides the web to be dewatered through the first press nip and is separated from the web after the first press nip. A second endless felt belt may be provided for the second press nip and it operates substantially in the same manner as the first felt belt. The press belt conducts the paper web to be dewatered through the first press nip around the central roll through the second press nip and then carries the web to a place where further transport means, usually connected with a dryer section of the machine, removes the web from the press belt.

These features of a press section are known from U.S. Pat. No. 4,359,827. That known press section is formed of a set of four or five rolls which include a central roll 50 which cooperates with two or three press rolls disposed at locations around the central roll to form a first press nip 14 and a second press nip 17. A press belt 15 travels through these two press nips. It travels onto the central roll 50 in front of or upstream of the first press nip 14 and leaves the central roll behind or downstream of the second press nip 17. A first endless felt belt 12 supports the web W, which is to be dewatered, on its path from the preceding wire section of the machine, first through a pre-press nip 13, and from there into the first press nip 14. The first felt belt 12 is separated from the web W directly after passing through the first press nip 14. From this place, the press belt 15 conducts the web W around the central roll 50. Possibly, the press belt and the web pass through an additional press nip 16. The belt 15 then conducts the web into the second press nip 17. After that nip, the press belt conducts the web to a web removal point at which a dryer wire belt 19 picks up the web with the aid of a removal suction roll 18 and transfers the web into a following dryer section.

One object of the invention in the above noted U.S. patent is to provide a paper making machine having no free and unsupported length of paper web, i.e. no open draw, anywhere between the wire screen section upstream of the press section and the dryer section downstream of the press section and, therefore, in particular also through the press section. This avoids the paper web being weakened along a free length of the paper web while it is still wet and therefore has only little strength. The U.S. patent says to expect that higher operating speeds, fewer breaks or tears of paper, and the use of cheaper raw materials will be possible.

The U.S. patent discloses that the permeability and porosity of the second press belt 15, are slight, probably meaning as compared with those features of a felt belt.

However, no further information about this is given in the U.S. patent.

One disadvantage of the press section of U.S. Pat. No. 4,359,827 is that it is difficult to detach the web from the press belt following the second press nip 17 and to reliably transfer the web to the dryer wire 19. It may be attempted to overcome these difficulties by increasing the vacuum prevailing in the removal suction roll 18, but with only slight success. There is a complicating circumstance that detachment of the web from the press belt is more difficult as the operating speed of the paper making machine increases.

U.S. Pat. No. 4,483,745 also describes different press sections in which a non-porous, water impervious press belt having a smooth surface travels through one or two of the press nips together with the web to be dewatered. Some of the embodiments are again disclosed as permitting no undesired open length of paper or open draw anywhere. However, the same problems will arise with regard to detachment of the web from the press belt as are present in an embodiment according to U.S. Pat. No. 4,359,827.

SUMMARY OF THE INVENTION

The object of the present invention is to further develop the known press section so that the operating speed of the paper making machine can be still further increased, up to an order of magnitude of between 1400 and 2000 meters per minute. At the same time, it should be possible to use a higher percentage of low grade raw materials, particularly waste paper, than previously. Furthermore, the risk of breaking or tearing of the web of paper is to be reduced and the economy of the manufacture of the paper is thereby improved. This particularly requires that the web be transferred with greater dependability than heretofore from the substantially water impervious press belt to the following conveyor belt which is, as a rule, a dryer wire. Particularly upon the manufacture of intaglio printing paper, an increase in the proportion of filler should also be possible, which should improve the printability of the finished paper.

In the invention, the distance along the guided path of the press belt from the second press nip to the place where the web is removed from the substantially water impervious press belt is to be considerably increased over what it has been. That distance is at least equal to the length of the circumference of the central roll, and is preferably a greater distance, in the range of 1.5 to 5 times and preferably in the range of 2 to 3 times the circumference of the central roll. This substantially lengthens the dwell time that the paper web spends between the last press nip and the place of its removal. During this lengthened dwell period the viscoelastic and previously flat pressed fibers can again become partially erect. This decreases the percentage of contact between the fibers and the smooth surface of the press belt. This also decreases the resistance to web removal so that the web can be removed from the smooth surface of the press belt with substantially less tensile stress, and it can therefore be removed considerably more gently than heretofore. As a result, the operating speed can be increased and the economy of the manufacture of the paper as a whole can be improved. This is due in part to the fact that the number of breaks or tears of the paper web, particularly at its place of removal, should be substantially reduced and in part to the fact that a higher proportion of low grade raw materials, for instance waste paper, can be used for the suspension.

An important further concept comprises combining the considerably increased distance from the second press nip to the place of removal with the feature that the two press rolls, or at least the press roll at the first nip, are developed as extended nip press rolls. This combination is based on the discovery that the considerable distance of the place of removal from the second press nip permits the press belt, which also serves as the web conveyor belt, to pass in succession through two extended press nips. It is particularly difficult to detach the web from the press belt following an extended press nip, through which the web has traveled in contact with a press belt, because the web comes into particularly intimate contact with the press belt as a result of its long dwell time within the press nip. Accordingly, the so called recovery time is also longer. This is the time, after emergence of the web from the press nip, during which the previously flat pressed fibers, as explained above, again in part erect themselves so that the percentage of joint contact between the press belt and the web becomes smaller. If the length of the extended press nip is, for instance, three times greater than the length of a press nip that is formed between two normal rolls, a recovery time of about three times longer is also necessary in order to be able to detach the web with sufficient ease from the press belt. It has been found, however, that the action of the lengthened time of stay of the web on the press belt following the last press nip, which has been described above, permits dependable removal of the web from the press belt even with extended press nips.

Furthermore, use of the extended nip press rolls permits their known advantages to be utilized, particularly when they are formed as so called shoe press rolls. These shoe press rolls, have a flexible, tubular press jacket which is hermetically closed at both its axial ends, and which is thus inflatable. The tubular jacket is pressed against the central roll by a concave slide surface of a non-rotating, radially displaceable press shoe. That surface faces toward the central roll. Such a press shoe roll is thus self-loading, i.e. its bearing brackets and the bearing brackets of the cooperating roll, namely the center roll need not be pushed radially toward each other.

The use of shoe type extended nip press rolls permits a considerable increase in the operating speed of the press because, the extended press nips, and the resultant lengthened pressing time, considerably increases the dewatering capacity of the press section. The paper web thus leaves the press section with a relatively high content of solids, as compared with standard roll pair nips, so that less water need be evaporated from the web in the following dryer section. Another advantage of the extended press nip is that relatively thin, finely woven felt belts can be used in the press section. This helps improve the quality of the final paper web.

There is a first felt belt which moves with the web and the press belt through the first press nip. A suction felt roll is disposed upstream of the first nip. The first felt belt partially wraps the suction felt roll and then travels with the web and the press belt to the first press nip. That measure helps prevent incoming air which travels in over a relatively large distance upstream of the first press nip, from being entrained between the web of paper and the press belt. In other words, even with very high operating speeds, the inclusion of air between the web of paper and the press belt is avoided and proper operation of the press section is thus assured.

Along the relatively long path of the web supporting press belt from the second nip to the place of web removal, a heating device may be provided near the press belt. It may be in the form of heat radiators and/or hot air nozzles. The heating device pre-heats the web and initially dries it before it is removed from the press belt and transferred to the dryer section of the paper making machine. The relatively long dwell time of the web between the pressing of the web and its removal from the central roll is used for the additional advantageous purpose of pre-drying the web by heating means. This causes the web to arrive at the critical web removal point with an even further increased solids content and with accordingly increased strength. Furthermore, the initial heating step decreases the viscosity of the water still present in the web, particularly at the contact surface between the paper web and the press belt. This further reduces the resistance to removal of the paper web from the press belt.

Further objects and features of the invention are explained below with reference to the drawings.

BRIEF DESCRIPTION OF THE DRAWINGS

FIG. 2 shows details of the main press nips in FIG. 1 on a larger scale.

FIG. 3 diagrammatically shows the cross-sectional shapes of the press shoes of the extended nip shoe presses or press rolls in FIGS. 1 and 2.

FIG. 4 is a partial section through the press belt along the line IV of FIG. 3.

DESCRIPTION OF THE PREFERRED EMBODIMENTS

Figure 1:
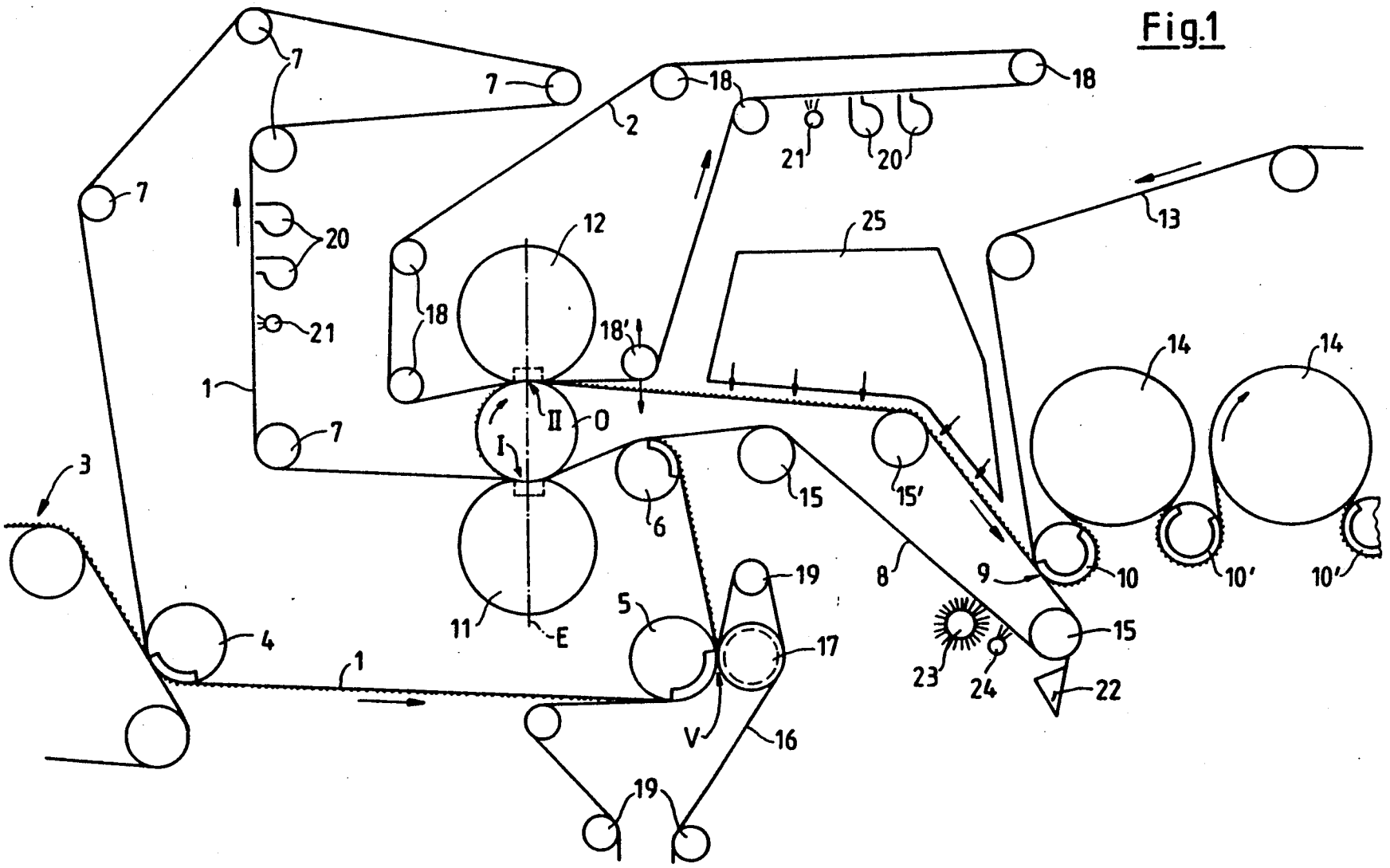
FIG. 1 diagrammatically shows a side view of a press section according to the invention.

The main part of the press section shown in FIG. 1 comprises a set of rolls. There is a central roll O which has a periphery and the periphery rotates in a rotary direction. The periphery of the central roll cooperates at one circumferential side with a first press roll 11 to form a first press nip I and cooperates at its opposite circumferential side with a second press roll 12 to form a second press nip II.

A substantially water impervious endless press belt 8, guided by press belt guide means described throughout this text, travels over the central roll 0 and travels in succession through the two press nips I and II. On the return trip of the press belt 8 between nip II and nip I, the belt 8 travels over a long path guided by the press belt guide rolls 15, 15'. The press belt travels onto the central roll 0 in front of the first press nip I and leaves the roll 0 after the second press nip II. The web of paper, which has been indicated by a dotted line on the belts and which is formed in a wire section 3, is picked up off the wire section 3 by a first endless felt belt 1. The felt belt 1 also is guided by felt belt guide means described throughout this text. The felt belt 1 wraps over a suction pick-up roll 4 at the time of pick off. The belt 1 with the web on it is fed over suction felt rolls 5 and 6 to the first press nip I.

A suction felt roll 6 lies at a distance in front of the first press nip I and is arranged so that the felt belt 1 carrying the web travels onto the suction felt roll 6 first and then the web contacts the press belt 8. From roll 6, the web travels sandwiched between the felt belt 1 above it in FIG. 1 and the press belt 8 below it in FIG. 1 to the first press nip I. The spacing of the roll 6 from the nip I removes entrained air carried by and between the belts to prevent entrained air entering the nip I with the web.

After passing the first press nip I, the first felt belt 1 separates from the web and from the press belt 8, and the belt 1 returns over a series of suction felt rolls 7 to the removal suction roll 4. The web, on the other hand, remains on and travels with the press belt 8 around about half the periphery of the central roll 0 and into the second press nip II. In many, but not all, machine installations, a second endless felt belt 2 travels through the second press nip II. The belt 2 separates from the web and from the press belt 8 following the second press nip II. At the exit from the nip II the felt belt 2 and the press belt 8 separate at an acute angle, which in most cases is smaller than 10°. over a series of suction felt rolls 18 and 18, If the second felt belt 2 is omitted, the hardness of the roll jacket over the shoe of the second extended nip or second press roll 12 should be less than the hardness of the web facing side of the press belt 8 in order for the web to travel further with the press belt 8 after the second press nip II. In order to obtain as high solids content of the web as possible and the highest possible speeds of travel, the second felt belt cannot usually be omitted.

The belt guide rolls 15 and 15' of the press belt 8 are arranged so that the press belt 8 travels over a relatively long distance after the second nip II from the central roll 0 to the region of the first dryer cylinder 14 of the dryer section which follows the press section. The press belt 8 conducts the web from the second press nip II up to a web removal place 9. There the web is transferred from the belt 8 by a suction pickup roll 10 to a dryer wire belt 13, and the web thereafter travels together with the wire 13 in known manner over each dryer cylinder 14 and a further suction guide roll 10' following the cylinder 14.

For the reasons explained above, the length of the path of travel of the press belt 8 from the second press nip II to its place of removal 9 is at least equal to the circumference of the central roll 0. This path length, however, is preferably two to three times and may even be in the range of one and one half to five times the circumference of the central roll 0.

The suction felt roll 5 can have a strengthened form, and together with a preferably grooved press roll 17, the roll 5 forms a pre-press nip V through which an additional felt belt 16 travels. The belt 16 is guided by felt guide rolls 19. The water removal capacity of the press section can be further increased by such a double-felt press arranged in front of the press nips I and II.

For cleaning the felt belts 1, 2 and 16, spray pipes 21 and suction boxes 20 can be provided in a customary manner. For cleaning the press belt 8 on its return trip after the web removal point and before the web contact point, a scraper 22, a spray tube 24, and a brush roll 23 are provided at the press belt. For cleaning the central roll 0 and the rolls 7, 15, 18 and 19, conventional scrapers can also be provided. They are not shown in the drawing.

In the zone along which the web travels together with the press belt from the second press nip II to the place of web removal 9, a heating device 25 comprised, for instance, of heat radiators and/or hot air nozzles, can be provided in order to heat and pre-dry the web.

In the embodiment shown, the axes of the central roll 0 and of the press rolls 11 and 12 on opposite sides of the central roll lie in a vertically arranged pressing plane E. The pressing plane E could however, also be inclined by up to 10°, particularly clockwise toward the top right in FIG. 1. In that case, the two suction felt rolls 5 and 6 could be combined into a single roll.

The direction of travel of the press belt 8 through the first press nip I should be opposite the general direction of travel of the web through the machine since, on the way from the first press nip I to the second press nip II, the direction of travel of the press belt 8 reverses and thereafter corresponds to the general direction of travel of the web through the machine. In the embodiment shown, the first press nip I lies below the second press nip II. This arrangement is preferred, because the web then lies on top of the press belt 8 on its unfelted path after the nip II and to the place of removal 9. The inverted arrangement of nips with nip I above and nip II below is also possible.

In order to save space along the length of the machine, the press belt 8 can be guided over a path curving roll 15' which deflects the press belt 8 out of a predominantly horizontal direction toward a downwardly inclined direction.

FIGS. 2 and 3 show the central roll 0 and the two press rolls 11 and 12 in larger size. The latter rolls are developed as extended nip presses or press rolls. They have respective flexible tubular press jackets 26, 27, the axial ends of which are hermetically closed in known manner by means of rotating disks (not shown) which rotate with the press jackets. Lubricant inside the press jackets cannot penetrate to the outside, and the inside of the jackets can be acted on by compressed air.

Through the inside of each extended nip press roll there extends respective stationary support member 28 and 29. Within the support members, respective press shoes 30 and 31 are supported in known manner. The shoes extend over the entire axial width of the web, have a concave, radially outward, slide surface and are adapted to be closed hydraulically in the radial direction. This enables the shoe slide surfaces to press the respective press jackets 26 and 27 against the central roll 0. The two press shoes 30 and 31 are shaped differently. The circumferential width b1 of the press shoe 30 of the first press roll 11, which is active upon the pressing, is greater than the circumferential width b2 of the press shoe 31 of the second press roll 12, which is active upon the pressing. On the other hand, the width B of the piston parts of both press shoes 30 and 31 is the same. Thus, the two support bodies 28 and 29 have substantially the same shape. The hydraulic pressure chambers which are behind and are operated for urging the press shoes 30, 31 radially toward the central roll are preferably also acted on by approximately equal pressures. Thus, substantially equal linear pressures are produced in both press nips I and II so that the lines of force acting on the central roll 0, aside from its own weight, approximately cancel each other out. This permits the central roll 0 to be developed as a simple roll mounted in normal bearings. It need not be developed as roll with adjustable sag. Furthermore, because of the difference in the widths of the press shoes, the pressure per unit of area produced in the first press nip I is less than in the second press nip II. This produces a relatively gentle but long lasting dewatering of the paper web in the first press nip I and a more intensive dewatering, which is of shorter duration, in the second press nip II. Alternatively, the support body and the press shoe, for instance 29 and 31, particularly at the nip II, could be replaced by a rotatable roll body.

In FIG. 2, on one of the two rolls ends, there are a bearing housing 35 of the central roll 0 and the two-part bearing brackets 36 and 37 in which the respective support bodies 28 and 29 of the extended nip press rolls 11 and 12 rest. The lower bearing bracket 36 rests on a temporarily removable intermediate piece 38, and the piece rests on a stationary machine frame 40, foundation, or the like. The upper bearing bracket 37 is suspended from the machine frame 40 by means of two tie members 39.

Two columns 41, 42 connect the bearing housing 35 and the two bearing brackets 36 and 37 to each other in form locked manner and completely rigidly. In normal operation, none of the bearing housings 35 or bearing brackets 36, 37 is moved. The radial displacement of the press shoes 30 and 31 is alone sufficient for applying pressing force. The two columns 41 and 42 can be temporarily removed for replacement of the felt belts 1 and 2, the press belt 8, or the press jackets 26, 27. For replacement of the press jackets 26, 27, the intermediate piece 38 and the brace elements 39 must also be removed. In order to avoid vibration, the columns 41, 42 can also be connected to the stationary machine frame 40, as indicated at 43, for instance.

In order to dewater as free of disturbance as possible and uniformly over the width of the machine in the press nips I and II, the following measures are provided, as shown in FIG. 3. The press belt 8 travels together with the felt belt 1 and together with the paper web lying between them to a point W onto the central roll 0. Point W is a distance in front of the entrance into the first press nip I. As a result, the press belt 8 and the felt 1 rest closely against the central roll 0 before the press jacket 26 contacts the felt belt 1. After the first press nip I, the first felt belt 1 leaves the central roll 0 at a point X, which lies at a distance after the exit point from the press nip I. This permits air to penetrate from below, directly after the exit point from the press nip I, into the felt 1 so that the felt easily detaches from the web. The point Y where the second felt belt 2 travels onto the central roll 0 is also a distance in front of the entrance into the second press nip II. Finally, the press belt 8 leaves the central roll 0 at a point Z located at a distance after the second press nip II. The second felt belt 2 forms an angle a of between 5 and 15°, and preferably 10°, with the press belt 8 in this region. This angle depends, among other things, on the type of paper and it can be varied by vertical displacement of the suction felt roll 18' (FIG. 1).

The press belt 8 is preferably made from a castable, hardened plastic, for instance polyurethane, having a reinforcement, for instance in the form of a fabric or, as shown in FIG. 4, in the form of inserted threads 44, in accordance with International Application WO 88/08897, which corresponds to U.S. application Ser. No. 299,829, filed Jan. 5, 1989. The hardness of the plastic, at least in the region of its web side surface 45, normally is in the range between 80 and 95 Shore A. The press belt 8 has a smooth, water impervious web side surface 45 and a thickness of about 2.5 to 5 mm. The opposite surface 46 of the press belt which faces the central roll 0 can also be smooth. However, that surface is preferably provided with recesses 47 for temporary storage of water. This avoids aquaplaning, which can be caused by water moving about within the press belt loop. Aquaplaning would undesirably increase the tensile stressing of the press belt 8 in the press nips I and II. The recesses 47 can, as is known, be developed as blind holes or as circumferential grooves, or can be formed by a reinforcement fabric which extends in part out of the plastic material.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A press section for a machine for manufacturing a paper web, comprising:

a central roll having a periphery with a circumference; a first press roll engaging the central roll at a first circumferential location around the periphery of the central roll and defining a first press nip; a second press roll engaging the central roll at a second circumferential location around the periphery of the central roll and defining a second press nip; the periphery of the central roll rotating in a direction from the first press nip to the second press nip;

a substantially water impervious, endless press belt engaging the central roll in front of the first press nip, moving through the first nip, traveling around the central roll to and through the second press nip and leaving the central roll after the second press nip;

a removal place in the press section after the second nip at which the web being dewatered in the press section is to be removed from the press belt, and means at the removal place for removing the web from the press belt;

means guiding the press belt so that the press belt can support the web while the press belt moves from in front of the first hip, to and through the first nip, around the periphery of the central roll, to and through the second nip, off the central roll and to the removal place at which the web is removed from the press belt;

the press belt being of a length and the removal place being so placed that the travel distance of the press belt from the second press nip to the removal place is at least the circumference of the central roll;

wherein said travel distance is sufficient to permit at least some web fibers which have been flattened in the first and second press nips to become at least partially erect so as to decrease contact between the fibers and the press belt and thereby decrease resistance of the web to removal from the press belt, thereby improving ease of removal of the web from the press belt at the removal place; and wherein the press belt supports the web from below, and the web is free of any applied pressure from above, during said travel distance from the second press nip to the removal place.

2. The press section of claim 1, further comprising an endless felt belt, means for guiding the felt belt to meet the press belt before the first nip and to travel with the press belt through the first nip, the felt belt cooperating with the press belt for guiding the web to be dewatered into the first nip while the web is between the felt belt and the press belt; and means further guiding the felt belt to separate from the web after the first press nip while the press belt with the web supported on it travels around the periphery of the central roll to the second nip.

3. The press section of claim 1, wherein the removal place is positioned so that the distance from the second press nip to the removal place is in the range of 1.5 to 5 times the circumference of the central roll.

4. The press section of claim 1, wherein the removal place is positioned so that the distance from the second press nip to the removal place is in the range of 2 to 3 times the circumference of the central roll.

5. The press section of claim 2, wherein at least the first press roll is an extended nip press roll including a press jacket for being pressed toward the central roll and a support element which is circumferentially extended partially around the central roll and between the press jacket and the central roll for pressing the press jacket toward the central roll.

6. The press section of claim 5, wherein the length in the circumferential direction of web travel of the first press nip is greater than that length of the second press nip.

7. The press section of claim 6, wherein the first and second press rolls include means for applying force radially toward the central roll and those force applying means apply such force to the central roll that the linear forces per length of web width are at least approximately the same in both of the press nips and differ by at most 20°.

8. The press section of claim 1, wherein each of the first and second press rolls comprises an extended nip press including a press jacket for being pressed toward the central roll and a support element which is circumferentially extended partially around the central roll and between the press jacket and the central roll for pressing the press jacket toward the central roll.

9. The press section of claim 8, wherein the length of the first press nip in the circumferential direction of the central roll is greater than that length of the second press nip.

10. The press section of claim 1, wherein the means guiding the press belt define a general direction of travel of the press belt with the web thereon from the second nip toward the removal place; the first nip and the means guiding the press belt being so placed that the direction of travel of the web through the first nip is at least approximately opposite the general direction of travel of the web from the second nip to the removal place.

11. The press section of claim 1, wherein the central roll and each of the first and second press rolls have respective axes and these axes lie at least approximately in a common press plane, the press plane being in the range of at least approximately vertical to an incline of at most 10° to the vertical.

12. The press section of claim 11, wherein the first press roll is below and the second press roll is above the central roll.

13. The press section of claim 1, wherein the first press roll is below and the second press roll is above the central roll.

14. The press section of claim 2, wherein the means guiding the press belt and the means guiding the felt belt are arranged so that the press belt together with the felt belt first contact the central roll at a point before the first press nip on the central roll, and the felt belt is guided by the respective felt belt guiding means to separate from the central roll at a point spaced beyond the exit of the felt belt from the first press nip.

15. The press section of claim 14, wherein the press belt guiding means supports the press belt to separate from the central roll at a point beyond the second press nip at the central roll.

16. The press section of claim i, wherein the press belt guiding means supports the press belt to separate from the central roll at a point beyond the second press nip at the central roll.

17. The press section of claim 2, further comprising a second felt belt and second felt belt guiding means guiding the second belt to travel through the second press nip with the support belt, the second felt belt guiding means and the press belt guiding means supporting the respective belts so that the second felt belt and the press belt form an acute angle in the range of 5° to 15° with each other after they leave the second press nip.

18. The press section of claim 1, further comprising a press belt path deflecting roll disposed between the second press nip and the web removal place and positioned to deflect the press belt with the web on it from a straight path away from the second nip to a bent off path, and the place of removal being beyond the deflecting roll along the bent off path of the press belt.

19. The press section of claim 1, further comprising web heating means disposed near the press belt along the path of the press belt between the second press nip and the web removal place.

20. The press section of claim 1, further comprising support and bearing means for the central roll and the press rolls and located toward the ends of the rolls, the respective support and bearing means are connected in form locked manner to each other for holding the rolls in their positions with respect to each other.

21. The press section of claim 1, further comprising press belt cleaning means at the web carrying surface of the press belt, positioned along the press belt after the web removal place and before the press belt meets the web and moves with the web through the first press nip.

22. The press section of claim 1, wherein the press belt has a web side surface which is the side thereof away from the central roll and toward the first and second rolls and the web side surface of the press belt is smooth and water impervious.

23. The press section of claim 22, wherein the press belt has an opposite surface which contacts the central roll, and the press belt opposite surface includes recesses for temporary storage of water.

24. The press section of claim 22, wherein the press belt web side surface has a hardness in the range of 80 to 95 Shore A.

25. The press section of claim 24, wherein the press belt and the web pass by the second roll and through the second press nip without a felt belt against the web, the second press roll having a peripheral press jacket which presses against the web on the press belt, the press jacket of the second press roll has a hardness that is less than the hardness of the web side surface of the press belt.

26. A press section for a machine for manufacturing a paper web, comprising:

a central roll having a periphery with a circumference; a first press roll engaging the central roll at a first circumferential location around the periphery of the central roll and defining a first press nip; a second press roll engaging the central roll at a second circumferential location around the periphery of the central roll and defining a second press nip; the periphery of the central roll rotating in a direction rom the first press nip to the second press nip;

a substantially water impervious, endless press belt engaging the central roll in front of the first press nip, moving through the first nip, traveling around the central roll to and through the second press nip and leaving the central roll after the second press nip;

a removal place in the press section after the second nip at which the web being dewatered in the press section is to be removed from the press belt, and means at the removal place for removing the web from the press belt;

means guiding the press belt so that the press belt can support the web while the press belt moves from in front of the first nip, to and through the first nip, around the periphery of the central roll, to and through the second nip, off the central roll and to the removal place at which the web is removed from the press belt;

the press belt being of a length and the removal place being so placed that the travel distance of the press belt from the second press nip to the removal place is at least the circumference of the central roll;

further comprising an endless felt belt, means for guiding the felt belt to meet the press belt before the first nip and to travel with the press belt through the first nip, the felt belt cooperating with the press belt for guiding the web to be dewatered into the first nip while the web is between the felt belt and the press belt;

means further guiding the felt belt to separate from the web after the first press nip while the press belt with the web supported on it travels around the periphery of the central roll to the second nip; and a suction felt roll spaced a distance before the first nip in the path of the press belt toward the central roll and toward the first nip; the felt belt guiding means guiding the felt belt which is carrying the web to first wrap around the suction felt roll and to then meet the press belt which is passing by the suction felt roll, and to support the felt belt and the press belt with the web between them as they travel together to the first press nip;

wherein said travel distance is sufficient to permit at least some web fibers which have been flattened in the first and second press nips to become at least partially erect so as to decrease contact between the fibers and the press belt and thereby decrease resistance of the web to removal from the press belt, thereby improving ease of removal of the web from the press belt at the removal place.

27. The press section of claim 26, further comprising a pair of pre-press rolls before the suction felt roll in the path of the felt belt, the pre-press rolls together defining a pre-press nip; the felt belt guiding means guiding the felt belt with the web thereon through the pre-press nip for initial dewatering.

28. The press section of claim 27, further comprising a second felt belt and second means guiding the second felt belt through the pre-press nip at the side of the first mentioned felt belt so that the web is sandwiched between the first felt belt and the second felt belt in the pre-press nip.

* * * * *